US005821026A

United States Patent [19]

Byers et al.

[11] Patent Number: 5,821,026

[45] Date of Patent: Oct. 13, 1998

[54] SUBSTRATE TREATMENT METHOD USING SOLUBLE PARTICLES

[75] Inventors: Catherine N. Byers, Williamson; Philip G. Perry, Webster; William G. Herbert, Williamson, all of N.Y.

[73] Assignee: Xerox Corporation, Stamford, Conn.

[21] Appl. No.: 847,903

[22] Filed: Apr. 28, 1997

[51] Int. Cl.[6] ..... G03G 5/10

[52] U.S. Cl. ..... 430/133; 430/69; 430/127; 451/38; 451/39; 451/40; 451/49

[58] Field of Search ..... 451/39, 40, 38, 451/49; 430/133, 127, 69

[56] References Cited

U.S. PATENT DOCUMENTS 5,160,547 11/1992 Kirschner et al. ..... 134/7
5,166,023 11/1992 Harada et al. ..... 430/69
5,302,485 4/1994 Swain ..... 430/127
5,365,702 11/1994 Shank, Jr. ..... 451/39
5,573,445 11/1996 Rasmussen et al. ..... 451/39
5,575,705 11/1996 Yam et al. ..... 451/39

*Primary Examiner*—Janis L. Dote
*Attorney, Agent, or Firm*—Zosan S. Soong

[57] ABSTRACT

There is disclosed a method for surface treating a substrate used in a photosensitive imaging member including: (a) impinging a honing composition comprised of particulate material against the substrate surface to create a surface roughness sufficient to substantially suppress formation of a pattern of light and dark interference fringes upon exposure of the photosensitive imaging member, wherein the particulate material is capable of being dissolved by a solvent; and (b) rinsing the substrate surface having the surface roughness with a cleansing composition comprised of the solvent, wherein any particulate material remaining on the substrate surface having the surface roughness is dissolved by the solvent.

10 Claims, No Drawings

SUBSTRATE TREATMENT METHOD USING SOLUBLE PARTICLES

FIELD OF THE INVENTION

This invention relates to a method for surface treating electrophotographic photoreceptor substrates.

BACKGROUND OF THE INVENTION

Coherent illumination is being increasingly used in electrophotographic printing for image formation on photoreceptors. Unfortunately, the use of coherent illumination sources in conjunction with multilayered photoreceptors results in a print quality defect known as the "plywood effect" or the "interference fringe effect." This defect consists of a series of dark and light interference patterns that occur when the coherent light is reflected from the interfaces that pervade multilayered photoreceptors. In organic photoreceptors, primarily the reflection from the air/charge transport layer interface (i.e., top surface) and the reflection from the undercoat layer or charge blocking layer/substrate interface (i.e., substrate surface) account for the interference fringe effect. The effect can be eliminated if the strong charge transport layer surface reflection or the strong substrate surface reflection is eliminated or suppressed.

Methods have been proposed to suppress the air/charge transport layer interface specular reflection, including roughening of the charge transport layer surface by introducing micron size $SiO_2$ dispersion and other particles into the charge transport layer, applying an appropriate overcoating layer and the like.

Methods have also been proposed to suppress the intensity of substrate surface specular reflection, e.g., coating specific materials such as anti-reflection materials and light scattering materials on the substrate surface and roughening methods such as dry blasting and liquid honing of the substrate surface. However, such methods must achieve their primary objective of eliminating substrate surface reflections without adversely impacting the electrical parameters or print quality of photoreceptors.

Photoreceptor substrate surfaces have been roughened by propelling ceramic and glass particles against a surface. Generally, these ceramic and glass particles have a random particle size distribution and often have an irregular shape. Because of random particle size distributions, the smaller particles used in roughening processes are often embedded into the surface of the roughened substrate. These small particles can cause black or white spots in the final electrophotographic image. Black spots occur in reversal development systems, wherein the discharged areas of an exposed photoreceptor are developed with toner particles. White spots occur in positive development systems, wherein the charged areas of an exposed photoreceptor are developed with toner particles. Also, the embedded particles are often released from the substrate during subsequent coating operations and contaminate the coating compositions that are applied to form the final photoreceptors. In addition, large particles used in the roughening process can cause large craters to form in the substrate surface, which adversely affect the thickness uniformity of the subsequently applied photoreceptor coatings.

When the particles used for roughening have an irregular shape, tiny fragments tend to break away from the particles and embed into the surface of the substrate due to the concentration of pressure during impact, particularly along the sharp edges of the particles. Moreover, small fragments that are broken away from the particles that do not lodge in the substrate surface often tenaciously adhere to the surface of the substrate due to electrostatic attraction or other phenomena and are difficult to remove prior to application of coatings. Further, control of the surface texture of the substrate is difficult, if not impossible, because the particles having an irregular shape cause the formation of an irregular texture with uneven depressions of many different sizes and shapes.

The embedded or tightly adhering fragments from the particles cause non-uniform coverage by subsequently applied coatings such as undercoating layers and charge generating layers. This, in turn, can cause black spots in the final electrophotographic images due to charge injection discharge of areas that normally retain a charge during discharged area (reversal) development. For charged area (positive) development, the defect appears as a white spot in the final xerographic image. In addition, the sharp edges on depressions can cause high fields to form during imaging, which, like the embedded or tightly adhering fragments, leads to the formation of black spots for reversal development or white spots for positive area development. Also, the deposited undercoating layers are non-uniform and uneven when applied over particle fragments or over deep depressions having sharp edges. Air bubbles can be formed when undercoating layers are applied to deep craters having sharp edges, and these air bubbles adversely affect coating uniformity.

Although materials such as ceramic materials can be shaped into a spherical shape, such shaping is complex, difficult and expensive. Moreover, ceramic materials such as those made from aluminum oxide are difficult to dispose of in an environmentally acceptable manner.

Thus, there is a need, which the present invention addresses, for new photoreceptor substrate honing methods that can remove embedded or tightly adhering honing particles, and fragments thereof, from the substrate surface.

Swain, U.S. Pat. No. 5,302,485 (roughening using refractory fibers) and Rasmussen et al., U.S. Pat. No. 5,573,445 (liquid honing) disclose methods to suppress the interference fringe effect in photosensitive members.

Kirschner et al., U.S. Pat. No. 5,160,547 and Yam et al., U.S. Pat. No. 5,575,705 disclose slurry blasting methods and blasting media to remove coatings from substrates.

SUMMARY OF THE INVENTION

The present invention is accomplished in embodiments by providing a method for surface treating a substrate used in a photosensitive imaging member comprising:

(a) impinging a honing composition comprised of particulate material against the substrate surface to create a surface roughness sufficient to substantially suppress formation of a pattern of light and dark interference fringes upon exposure of the photosensitive imaging member, wherein the particulate material is capable of being dissolved by a solvent; and (b) rinsing the substrate surface having the surface roughness with a cleansing composition comprised of the solvent, wherein any particulate material remaining on the substrate surface having the surface roughness is dissolved by the solvent.

DETAILED DESCRIPTION

The honing composition may be dry (i.e., absent any fluid, where only the particulate material is present) or may include a liquid. When a liquid is present, the particulate material may be substantially insoluble in the liquid, where the amount of the undissolved particulate material ranges from about 90% to 100% by weight based on the total weight of the particulate material in the honing composition. In other embodiments, the honing composition may be a slurry, where the particulate material is soluble in the liquid but the honing composition is a saturated solution of the particulate material so as to minimize dissolution of the particulate material in the liquid. Having a saturated solution ensures sufficient abrasiveness of the honing composition. The particulate material may be present in the honing composition in an amount ranging from about 5% to about 25% volume solids, preferably from about 10% to about 20% volume solids wherein the phrase volume solids when used to describe the quantity of the particulate material refers to the volume of the particulate material in the honing composition based on the total volume of the honing composition. A buffer, a dispersant, and/or a surfactant may be optionally present in the honing composition at a concentration for example of less than about 1% by weight based on the weight of the honing composition.

The particulate material is selected to be one that can dissolve, preferably readily, into a solvent such as water or an organic fluid. The particulate material is preferably a salt including for example the alkali metal salts and the alkaline earth metal salts such as the chlorides, chlorates, carbonates, bicarbonates, sesquicarbonates, sulfates, silicates, the hydrates of the above, and the like. The preferred salts are alkali metal salts and, in particular, sodium and potassium carbonates, bicarbonates, and sulfates. In addition, sodium chloride may be used. Mixtures of two, three, or more different particulate materials may be employed in any suitable proportion. The particulate material may have a density ranging from about 2 to about 3 g/cc. The particulate material may have a particle size ranging for example from 10 to about 500 microns, and preferably from about 15 to about 50 microns. The particulate material preferably has a crystalline shape and may have a Mohs hardness of less than about 5.0, preferably from about 2.0 to about 4.0.

The liquid in the honing composition may be any suitable fluid such as water, preferably deionized water, or organic fluids such as alcohols, polyhydric alcohols, alkyl halides, and methylene chloride. Mixtures of two, three, or more liquids can be employed in the honing composition.

The cleansing composition contains the solvent which may be the same or different fluid than the liquid in the honing composition. Suitable solvents include water, preferably deionized water, or organic fluids such as alcohols, polyhydric alcohols, alkyl halides, and methylene chloride. Preferred solvents are those that can dissolve salts. Mixtures of two, three, or more solvents can be employed in the cleansing composition. A buffer, a dispersant, and/or a surfactant may be optionally present in the cleansing composition at a concentration for example of less than about 1% by weight based on the weight of the cleansing composition.

Any suitable substrate may be treated by the present invention including metal substrates typically employed as photoreceptor substrates such as those fabricated from for example stainless steel, nickel, aluminum, and alloys thereof. Aluminum or aluminum alloy substrates are preferred. Typical aluminum alloys include, for example, 1050, 1100, 3003, 6061, 6063, and the like. Alloy 3003 contains AL, 0.12 percent by weight Si, 0.43 percent by weight Fe, 0.14 percent by weight Cu, 1.04 percent by weight Mn, 0.01 percent by weight Mg, 0.01 percent by weight Zn, 0.01 percent by weight Ti, and a trace amount of Cr. The size and distribution of inclusions and intermetallic compounds in the alloy should be below the level at which the inclusions and intermetallic particles would pose a problem for the honing process. Nonuniform surface texture with patches of unhoned regions may result if many large inclusions or intermetallics are present. Similarly, the ductility properties of the aluminum substrate should be substantially uniform to ensure a uniform texture upon completion of the honing process. Generally, the surface of the substrate may be relatively smooth prior to honing. Typical smooth surfaces are formed by, e.g., diamond lathing, specialized extrusion and drawing processes, grinding, buffing and the like. After smoothing but prior to any honing, the substrate surface roughness should be in the range of about $R_a$ of 0.005 micrometers, $R_{max}$ of 0.05 micrometers to about $R_a$ of 0.13 micrometers, $R_{max}$ of 1.3 micrometers. $R_a$ is the arithmetic average of all departures of the roughness profile from the center line within the evaluation length. $R_a$ is defined by a formula:

$$R_a = \frac{1}{l_m} \int_0^{l_m} |y| dx$$

in which $l_m$ represents the evaluation length, and $|y|$ represents the absolute value of departures of the roughness profile from the center line.

The expression $R_{max}$ represents the largest single roughness gap within the evaluation length. The evaluation length is that part of the traversing length that is evaluated. An evaluation length containing five consecutive sampling lengths is taken as a standard.

Typically, the substrate is cylindrical or drum-shaped, and is cleaned by any suitable technique prior to honing to remove any foreign substances introduced to the surface during any of the aforementioned smoothing processes. Although a cylindrical substrate is preferred, as long as honing process parameters are met, any substrate geometry such as a hollow or solid cylinder, a flat sheet, a seamed or unseamed belt, or any other form that allows the utilization of conventional coating techniques such as dip coating, vapor deposition and the like can be used.

The surface morphology produced by the present method may be defined by the following parameters: $R_a$ (mean roughness), $R_t$ (maximum roughness depth), $R_{pm}$ (mean levelling depth), $W_t$ (waviness depth), and $P_t$ (profile depth), wherein preferred values for minimizing or eliminating the interference fringe effect are described below. $R_a$ is defined above and preferably ranges from about 0.05 to about 0.7 micron, more preferably from about 0.1 to about 0.6 micron, and most preferably from about 0.10 to about 0.55 micron. $R_t$ is the vertical distance between the highest peak and the lowest valley of the roughness profile R within the evaluation length and preferably ranges from about 0.5 to about 6 microns, and more preferably from about 0.8 to about 4.5 microns. $R_{pm}$ is the mean of five levelling depths of five successive sample lengths and preferably ranges from about 0.2 to about 2 microns, and more preferably from about 0.3 to about 1.5 microns. $W_t$ is the vertical distance between the highest and lowest points of the waviness profile W within the evaluation length and preferably ranges from about 0.1 to about 1 micron, and more preferably from about 0.15 to about 0.5 micron. $P_t$ is the distance between two parallel lines enveloping the profile within the evaluation length at their minimum separation and preferably ranges from about 0.8 to about 6 microns, and more preferably from about 1 to about 4 microns. Significant suppression of the interference fringe effect may be observed in embodiments of the present invention at the light source wavelengths conventionally used, including a light source having a wavelength at 780 nm.

All measurements of the various surface roughness parameters described herein may be made with a profilameter such as Perthen Model S3P or Model S8P manufactured by Mahr Feinpruef Corporation. Generally, a stylus with a diamond tip is traversed over the surface of the roughened substrate at a constant speed to obtain all data points within an evaluation length. The radius of curvature of the diamond tip used to obtain all data referred to herein is 5 microns.

The present method creates the desired surface roughness with minimal removal of the substrate surface material. This can be verified by determining whether there is a change in color in the used honing composition which is collected after the honing step where a change in color indicates the presence of excessive amounts of the substrate surface material. In addition, the used honing composition can be analyzed chemically to determine the amount of suspended and/or dissolved substrate surface material.

The following description illustrates the present method in more detail. A spray gun sprays the present honing composition at the surface of a cylindrical substrate. The distance between the spray gun and the substrate to be treated is between about 100 mm and about 300 mm. The cylindrical substrate is rotated about its axis at a surface speed of between about 12 cm/sec and about 35 cm/sec (for the product sizes tested) or about 80 rpm. Particulate material is present in the wet honing composition in an amount ranging from about 7% to about 10% volume solids, with the remainder deionized water. The pressure applied through a tube to the honing composition as it is fed to the spray gun is about 3.0 to about 4.0 kg/cm$^2$, preferably about 3.1 to about 3.8 kg/cm$_2$. The spray gun is reciprocated at a speed of between about 250 mm/min and about 350 mm/min along an axis parallel to the axis of the cylindrical substrate. An acceptable surface roughness as described herein on the surface of the substrate can be achieved in a single pass of the spray gun. These parameters are generally applicable to spray guns having a nozzle of a diameter between about 5 mm and about 10 mm. If desired, the ends of the cylindrical substrate may be masked to prevent roughening of the area that is to remain free of coating material. Masking may be accomplished by any suitable technique that provides a shield between the substrate and the honing media.

The following Table illustrates preferred parameters for the present honing method:

| Particulate Material | Honing Composition Liquid | Percent Solids In Honing Composition By Volume | Nozzle Diameter (mm) | Gun to Drum Distance (mm) | Air Pressure (psi) | Cleansing Liquid | Concentration (Vol %) Based On Volume Of Cleansing Liquid |
|---|---|---|---|---|---|---|---|
| ZnO | $H_2O$ | 5–10 | 8 | 200 | 20 | $HCl/H_2O$* | 5–10 |
| NaCl | $PEG/H_2O$** | 5–10 | 10 | 260 | 15 | $H_2O$ | 100 |
| $CaCO_3$ | $H_2O$ | 10–15 | 8 | 200 | 20 | $HCl/H_2O$* | 5–10 |

*The HCl facilitates removal of residual particulate material on the substrate.

**The PEG (polyethylene glycol) and water are present in for example a 50/50 mixture by volume; the PEG increases the viscosity of the honing composition and reduces the NaCl solubility.

In embodiments, the surface of the substrate after completion of the honing process may exhibits an irregular pattern (e.g., indents, scalloped or craters of less than 4 microns crater depth and/or no flats) having a controlled surface roughness, free of embedded particles or large craters produced by prior art honing methods. This surface structure also may be free of sharp crevices where protruding edges can adversely affect the uniformity of the undercoating layer and charge generating layer.

The present invention offers a number of benefits. For example, the frequency of clogs and system flushes to the honing equipment is reduced since the particulate material is readily soluble in one or more solvents in contrast to conventional honing compositions employing insoluble honing media which can harden and be difficult to remove from the honing equipment. In addition, rinsing with the cleansing composition can remove residual particulate material embedded in or adhered to the substrate surface, thereby increasing the quality of the substrate surface. Moreover, the liquid in the honing composition and the solvent can be selected to be environmentally friendly such as by using water.

In fabricating a photosensitive imaging member, a charge generating material (CGM) and a charge transport material (CTM) may be deposited onto the substrate surface either in a laminate type configuration where the CGM and CTM are in different layers or in a single layer configuration where the CGM and CTM are in the same layer along with a binder resin. Illustrative organic photoconductive charge generating materials include azo pigments such as Sudan Red, Dian Blue, Janus Green B, and the like; quinone pigments such as Algol Yellow, Pyrene Quinone, Indanthrene Brilliant Violet RRP, and the like; quinocyanine pigments; perylene pigments; indigo pigments such as indigo, thioindigo, and the like; bisbenzoimidazole pigments such as Indofast Orange toner, and the like; phthalocyanine pigments such as copper phthalocyanine, aluminochloro-phthalocyanine, and the like; quinacridone pigments; or azulene compounds. Suitable inorganic photoconductive charge generating materials include for example cadium sulfide, cadmium sulfoselenide, cadmium selenide, crystalline and amorphous selenium, lead oxide and other chalcogenides. Alloys of selenium are encompassed by embodiments of the instant invention and include for instance selenium-arsenic, selenium-tellurium-arsenic, and selenium-tellurium.

Any suitable inactive resin binder material may be employed in the charge generating layer. Typical organic resinous binders include polycarbonates, acrylate polymers, methacrylate polymers, vinyl polymers, cellulose polymers, polyesters, polysiloxanes, polyamides, polyurethanes, epoxies, polyvinylacetals, and the like.

Charge transport materials include an organic polymer or non-polymeric material capable of supporting the injection of photoexcited holes or transporting electrons from the photoconductive material and allowing the transport of these holes or electrons through the organic layer to selectively dissipate a surface charge. Illustrative charge transport materials include for example a positive hole transporting material selected from compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and hydrazone compounds. Typical hole transport materials include electron donor materials, such as carbazole; N-ethyl carbazole; N-isopropyl carbazole; N-phenyl carbazole; tetraphenylpyrene; 1-methyl pyrene; perylene; chrysene; anthracene; tetraphene; 2-phenyl naphthalene; azopyrene; 1-ethyl pyrene; acetyl pyrene; 2,3-benzochrysene; 2,4-benzopyrene; 1,4-bromopyrene; poly(N-vinylcarbazole); poly(vinylpyrene); poly(vinyltetraphene); poly(vinyltetracene) and poly (vinylperylene). Suitable electron transport materials include electron acceptors such as 2,4,7-trinitro-9-fluorenone; 2,4,5,7-tetranitro-fluorenone; dinitroanthracene; dinitroacridene; tetracyanopyrene and dinitroanthraquinone.

Any suitable inactive resin binder may be employed in the charge transport layer. Typical inactive resin binders soluble in methylene chloride include polycarbonate resin, polyvinylcarbazole, polyester, polyarylate, polystyrene, polyacrylate, polyether, polysulfone, and the like. Molecular weights can vary from about 20,000 to about 1,500,000.

Any suitable technique may be utilized to apply the charge transport layer and the charge generating layer. Typical application techniques include spraying, dip coating, roll coating, wire wound rod coating, and the like. Drying of the deposited coating may be effected by any suitable conventional technique such as oven drying, infrared radiation drying, air drying and the like. Generally, the thickness of the charge generating layer ranges from about 0.1 micron to about 3 microns and the thickness of the transport layer is between about 5 microns to about 100 microns, but thicknesses outside these ranges can also be used. In general, the ratio of the thickness of the charge transport layer to the charge generating layer is preferably maintained from about 2:1 to 200:1 and in some instances as great as 400:1.

The photosensitive imaging member produced according to the invention can be tested for print quality assessment in Xerox laser printer model 4213 at an initial charging voltage of about 380 volts. The 4213 laser printer has a 780 nm wavelength laser diode as the exposure source and a single component discharged area development (DAD) system with 11 micron toner. Interference fringe effect is tested in a gray scale print mode using specified halftone patterns. The interference fringes, or plywood fringes, are not observed, and no degradation of print quality is observed due to black spots. Similar results may be achieved with other laser-based machines, e.g., those with an exposure light source that operates in the range of 600–800 nm.

Other modifications of the present invention may occur to those skilled in the art based upon a reading of the present disclosure and these modifications are intended to be included within the scope of the present invention.

We claim:

1. A method for surface treating a substrate used in a photosensitive imaging member comprising:

(a) providing a substrate and impinging a honing composition comprised of a liquid and a particulate material against the substrate surface to create a predetermined surface roughness wherein the particulate material is substantially insoluble in the liquid; and (b) rinsing the substrate surface having the predetermined surface roughness with a cleansing composition comprised of a solvent, wherein any particulate material remaining on the substrate surface having the predetermined surface roughness is dissolved by the solvent.

2. The method of claim 1, wherein the particulate material is a salt.

3. The method of claim 1, wherein the solvent is water.

4. The method of claim 1 wherein the particulate material is insoluble in the liquid.

5. The method of claim 1 wherein the liquid and the solvent are independently selected from the group consisting of water and an organic fluid.

6. The method of claim 1, wherein the particulate material is present in an amount ranging from about 5% to about 25% volume solids.

7. The method of claim 1, wherein the particulate material is selected from the group consisting of alkali metal salts and alkaline earth metal salts.

8. The method of claim 1, wherein the impinging of the honing composition against the substrate surface with the composition is accomplished with minimal removal of the substrate surface material.

9. The method of claim 1, wherein the predetermined surface roughness is defined by $R_a$ ranging from about 0.05 to about 0.7 micron, $R_t$ ranging from about 0.5 to about 6 microns, $R_{pm}$ ranging from about 0.2 to about 2 microns, $W_t$ ranging from about 0.1 to about 1 micron, $P_t$ ranging from about 0.8 to about 6 microns.

10. The method of claim 1, further comprising depositing onto the substrate surface having the predetermined surface roughness a material selected from the group consisting of a charge generating material and a charge transport material.

* * * * *